US008025298B2

(12) United States Patent
Chen

(10) Patent No.: US 8,025,298 B2
(45) Date of Patent: Sep. 27, 2011

(54) SIDEWAYS-MOVING ICE SKATE

(75) Inventor: Shane Chen, Camas, WA (US)

(73) Assignee: Shane Chen, Camas, WA (US)

( * ) Notice: Subject to any disclaimer, the term of this patent is extended or adjusted under 35 U.S.C. 154(b) by 401 days.

(21) Appl. No.: 12/327,340

(22) Filed: Dec. 3, 2008

(65) Prior Publication Data

US 2010/0133765 A1 Jun. 3, 2010

(51) Int. Cl.
*A63C 1/00* (2006.01)

(52) U.S. Cl. ..... 280/11.18

(58) Field of Classification Search ..... 280/11.12, 280/11.18

See application file for complete search history.

(56) References Cited

U.S. PATENT DOCUMENTS 6,523,835 B1 * 2/2003 Lyden ..... 280/11.12
7,059,613 B2 * 6/2006 Farrelly et al. ..... 280/11.27

* cited by examiner

*Primary Examiner* — J. Allen Shriver, II
*Assistant Examiner* — Erez Gurari

(57) ABSTRACT

An ice skate whose blade is disposed at an angle not parallel to the longitudinal axis of the boot. The blade may be fixed in this position, or it may be switchable between the nonparallel orientation of the present invention and the parallel orientation typical of traditional ice skates. A pair of sideways-moving skates may be propelled by moving them in an oscillating motion.

6 Claims, 4 Drawing Sheets

SIDEWAYS-MOVING ICE SKATE

FIELD OF THE INVENTION

This invention relates to ice skates. It also relates to sideways-moving foot devices, in particular those which are propelled by associating one device to each foot and moving the feet in an oscillating motion. This invention reapplies the concepts of said sideways-moving foot devices in the context of ice skating.

BACKGROUND OF THE INVENTION

The blade of a traditional ice skate is oriented parallel to the longitudinal axis of the boot, and the skater moves forward or backward. The sideways ice skate of the present invention is an alternative to the traditional ice skate. The sideways ice skate comprises the same key elements as the traditional ice skate, but the blade is mounted so as to be substantially nonparallel to the longitudinal axis of the boot (for instance, the blade may be perpendicular to the longitudinal axis of the boot). The skater thus moves sideways.

The device that bears the most similarity to the sideways-moving ice skate is a sideways-moving wheeled device intended primarily for use on pavement or other similar surfaces. The most relevant of these is the Personal Transportation Device for Supporting a User's Foot Having Multiple Transportation Attachments disclosed in U.S. Pat. No. 7,059,613 B2. One of the possible transportation attachments mentioned in the '613 patent is a blade for ice skating. Both with the ice skate embodiment of the '613 patent and with the ice skate of the present invention, the user associates one unit with each foot, and then moves the feet in an oscillating motion for sideways propulsion. However, the transportation devices of the '613 patent interface with the user by means of footboards that support the user's feet, whereas the ice skate of the present invention interfaces with the user by means of a boot, as is the case with most personal transportation devices used for traversing ice surfaces. The boot is functionally different from the footboards because it is conducive to a different range of maneuvers, including advanced and/or aggressive maneuvers that require a high degree of stability and support.

DETAILED DESCRIPTION

Figure 1:
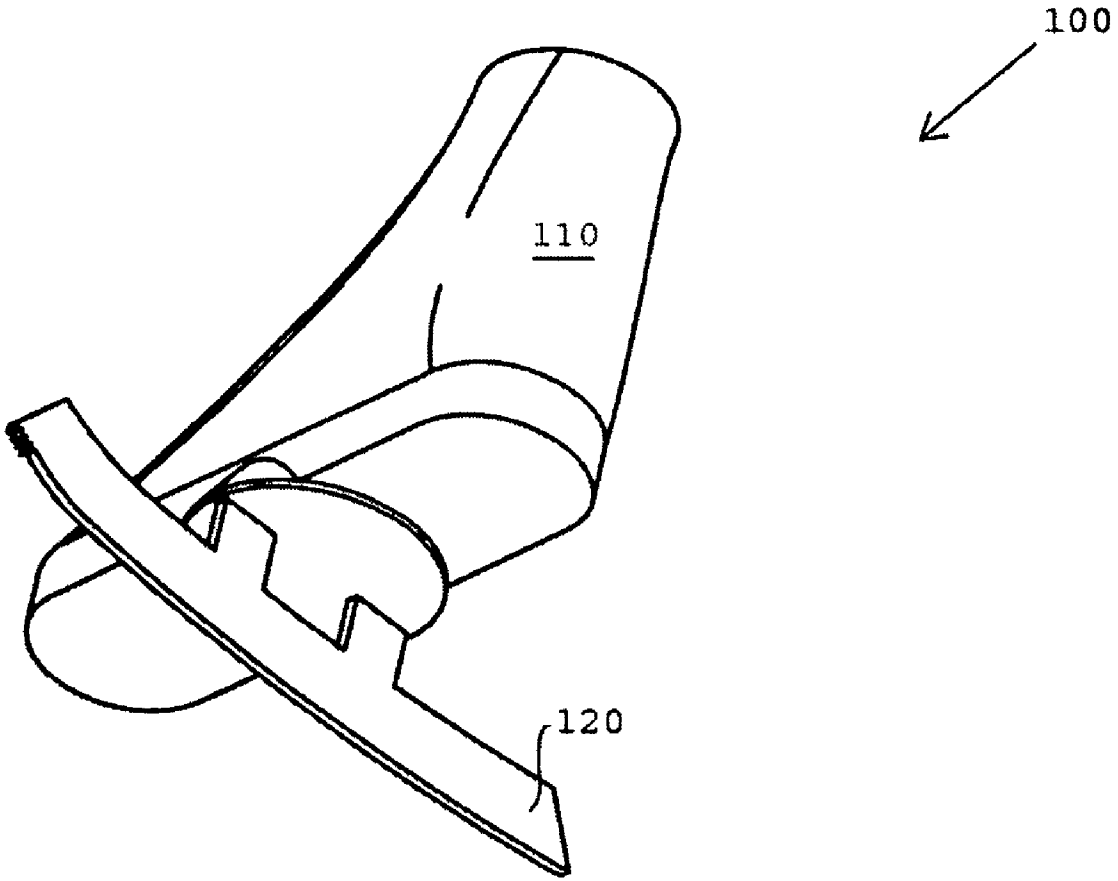
FIG. 1 is a perspective view of an embodiment of a sideways-moving ice skate in accordance with the present invention.

Referring to FIG. 1, a perspective view of one embodiment of a sideways-moving ice skate 100 in accordance with the present invention is shown. Blade 120 is coupled to boot 110, and is oriented so as to be substantially nonparallel to the longitudinal axis of boot 110. The optimal angles of displacement of blade 120 from the longitudinal axis of boot 110 are those between 30 and 150 degrees (in the embodiment of FIG. 1, the angle is 90 degrees). The user can propel a pair of skates sideways by moving the skates in an oscillating motion.

Figure 2:
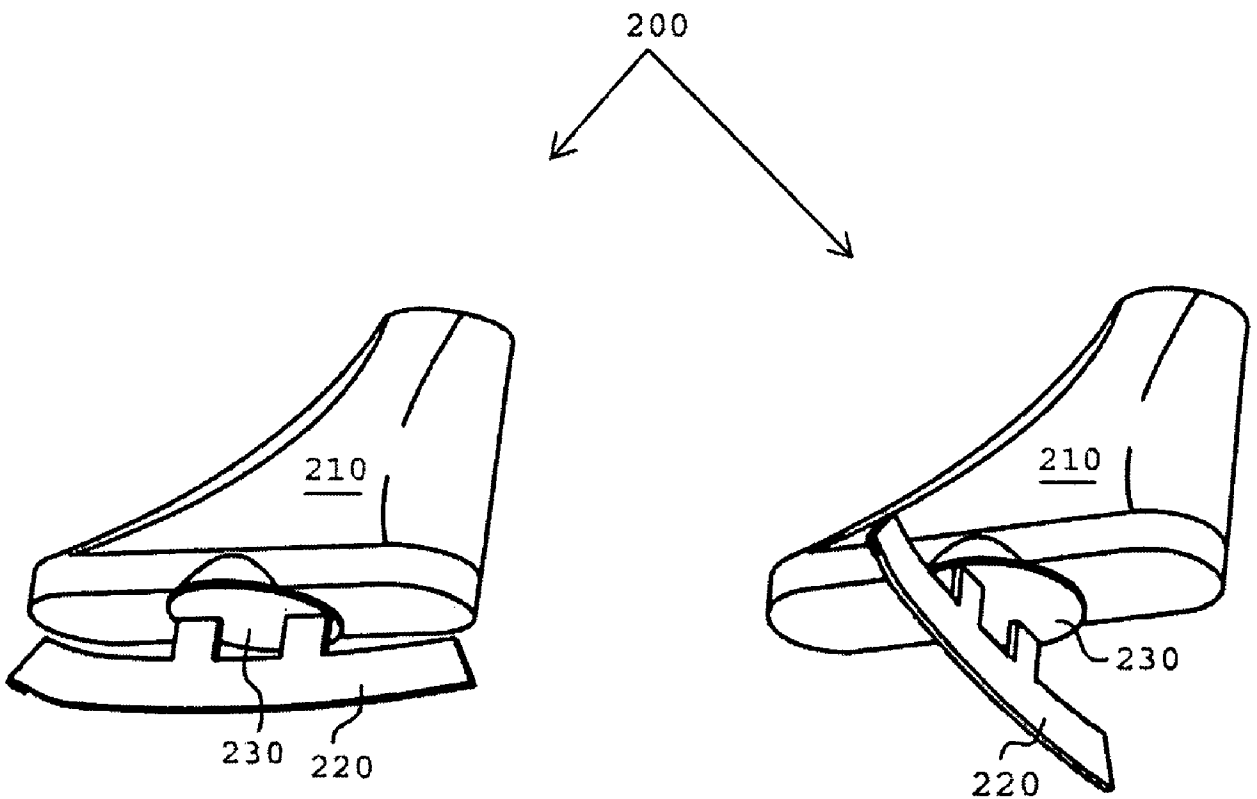
FIG. 2 consists of two perspective views of another embodiment of a sideways-moving ice skate, wherein the blade can be converted between a parallel position and a nonparallel position.

Referring to FIG. 2, a perspective view of another embodiment of a sideways-moving ice skate 200 in accordance with the present invention is shown. In addition to the nonparallel orientation of skate 100 of FIG. 1, blade 220 can also occupy a parallel orientation, wherein the blade is substantially parallel to the longitudinal axis of boot 210 (i.e. the orientation typical of traditional ice skates). A means is provided for converting blade 220 between the parallel orientation and the nonparallel orientation. There are a variety of mechanisms by which the conversion may be achieved. The preferred embodiment comprises a pivoting plate 230, which is rotatably coupled to the bottom surface of boot 210 and rigidly coupled to the top surface(s) of blade 220. Rotation of pivoting plate 230 therefore causes pivoting of blade 220 from the parallel orientation to the nonparallel orientation, and vice versa. In another possible embodiment, the blade may be detached while in one of the two orientations and then reattached in the other orientation. In any embodiment of the mechanism for switching the orientation of blade 220, a locking mechanism or mechanisms may be provided for selectively securing the blade in the two orientations.

Figure 3:
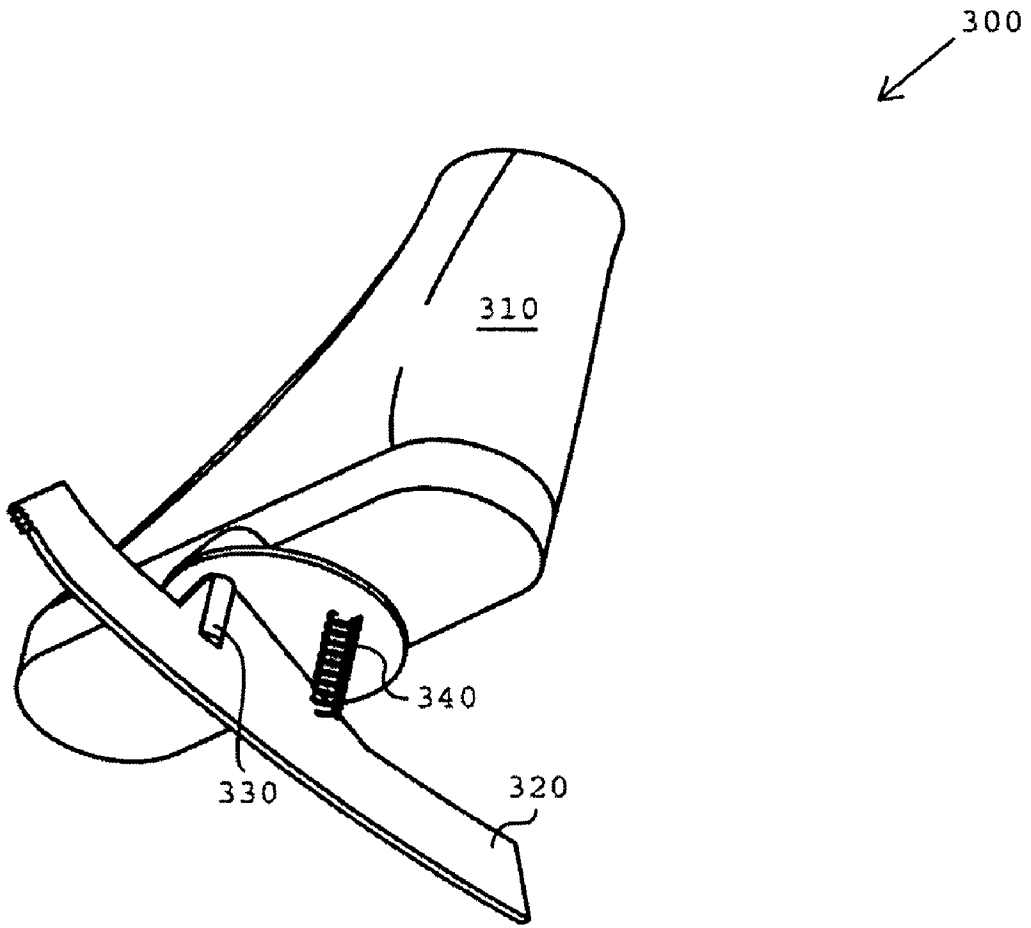
FIG. 3 is a perspective view of an embodiment of a sideways-moving ice skate with a biased pivoting blade.

Referring to FIG. 3, a perspective view of another embodiment of a sideways-moving ice skate 300 in accordance with the present invention is shown. Skate 300 comprises blade 320, which may be rotatably coupled to boot 310 by means of pivot shaft 330. The junction of pivot shaft 330 and blade 320 is located toward the leading end of blade 320 relative to the center of mass of blade 320. This placement of the junction ensures that blade 320 changes angle according to the motion of skate 300 as follows: when skate 300 is moved forward, blade 320 changes angle so that its leading end is farther forward than its trailing end. Conversely, when skate 300 is moved backward, blade 320 changes angle so that its leading end is farther backward than its trailing end. (Note that "forward" refers to the direction of the toe of boot 310, not the direction of travel, and "backward" refers to the direction of the heel.) Skate 300 may further comprise a pivot damping mechanism 340 which resists the pivoting of blade 320. While skate 300 is being moved forward or backward, the resistance provided by pivot damping mechanism 340 tends to prevent blade 320 from becoming parallel to the velocity of skate 300, thereby maintaining a propelling force. Pivot damping mechanism 340 may have a variety of different embodiments, including those wherein the resisting force is provided by springs or by gravity. The overall effect is to simplify the method of propulsion; since blade 320 can inherently change angle according to the motion of skate 300 and then tends to return to the neutral position, the user does not need to control the angle of the blade, and propulsion can be achieved by simply moving skates 300 forward and backward.

Figure 4:
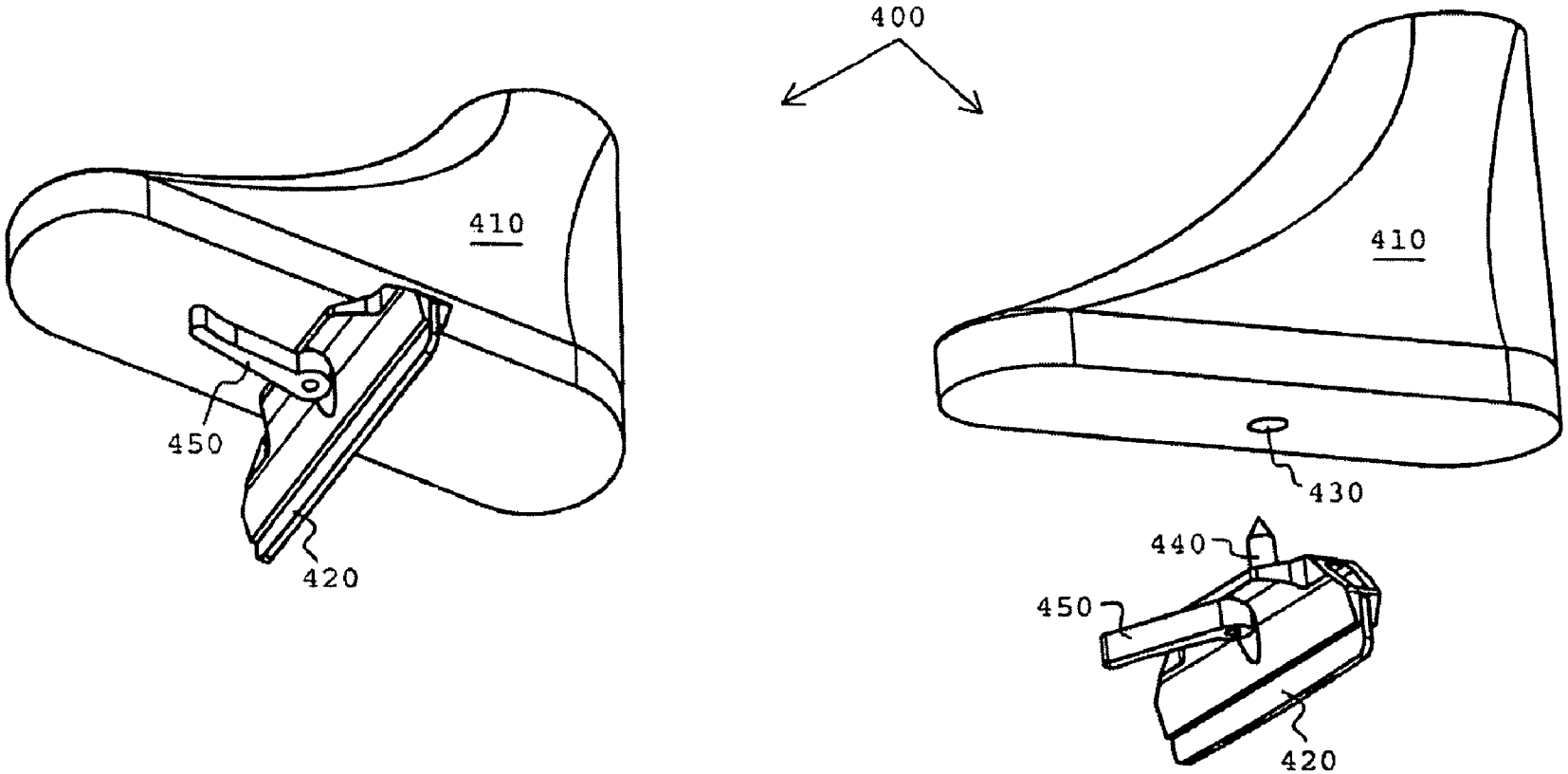
FIG. 4 is a perspective view of another embodiment of a sideways-moving ice skate, wherein the blade can be easily detached and reattached.

Referring to FIG. 4, a perspective view of another embodiment of a sideways-moving ice skate 400 in accordance with the present invention is shown. A means is provided for detaching (and reattaching) blade 420 from boot 410. Preferably, the detachment and reattachment may be done quickly and without the use of tools. In one possible embodiment, skate 400 may further comprise an attaching member 440, which may be received by a receiving cavity 430 on the bottom surface of boot 410. Locking lever 450 may be provided, and may selectively occupy a locked position, wherein attaching member 440 cannot be removed from receiving cavity 430; and an unlocked position, wherein attaching member 440 can be removed from receiving cavity 430. Detachment of the blade enables the user to walk more easily while still wearing boot 410.

The invention claimed is:

1. An ice skate comprising:

a boot; and a blade coupled to the boot, disposed at an angle substantially nonparallel to the longitudinal axis of the boot;

wherein the blade can pivot relative to the boot while the skate is in use; and wherein the pivoting of the blade occurs about a vertical axis offset toward the leading end of the blade relative to the center of mass of the blade.

2. The ice skate of claim 1, wherein the blade is disposed at an angle of 30 to 150 degrees relative to the longitudinal axis of the boot when in a neutral, non-pivoted position.

3. The ice skate of claim 2, wherein the blade is substantially perpendicular to the longitudinal axis of the boot when in a neutral, non-pivoted position.

4. The ice skate of claim 1, wherein:

the blade may alternatively occupy a parallel position in which the blade is substantially parallel with the longitudinal axis of the boot; and a means is provided for switching the blade from the nonparallel position described in claim 1 to the parallel position, and vice versa.

5. The ice skate of claim 1, further comprising a pivot damping mechanism which resists the pivoting of the blade.

6. The ice skate of claim 1, further comprising a mechanism for detaching the blade from the boot without the use of tools.

* * * * *